US008573645B2

(12) United States Patent
Lefevre et al.

(10) Patent No.: US 8,573,645 B2
(45) Date of Patent: Nov. 5, 2013

(54) GAS GENERATOR AND MANUFACTURING PROCESS THEREOF

(75) Inventors: Wilfried Lefevre, Ploeven (FR); Thierry Maisonnette, Saint Witz (FR); Marie-Hélène Bischoff-Barre, Compiègne (FR); Benoit Sable, Daoulas (FR); Gérald Prima, Landrevarzec (FR); Christophe Gatoux, Othis (FR)

(73) Assignee: Autoliv Development AB, Vargarda (SE)

( * ) Notice: Subject to any disclaimer, the term of this patent is extended or adjusted under 35 U.S.C. 154(b) by 0 days.

(21) Appl. No.: 13/700,517

(22) PCT Filed: May 30, 2011

(86) PCT No.: PCT/EP2011/058798

§ 371 (c)(1),
(2), (4) Date: Nov. 28, 2012

(87) PCT Pub. No.: WO2011/151276

PCT Pub. Date: Dec. 8, 2011

(65) Prior Publication Data

US 2013/0068123 A1 Mar. 21, 2013

(30) Foreign Application Priority Data

Jun. 2, 2010 (FR) ..... 10 54302

(51) Int. Cl.
*B60R 21/26* (2011.01)

(52) U.S. Cl.
USPC ..... 280/741; 280/736; 102/530

(58) Field of Classification Search
USPC ..... 280/736, 741; 102/530
See application file for complete search history.

(56) References Cited

U.S. PATENT DOCUMENTS 5,558,366 A * 9/1996 Fogle et al. ..... 280/736
5,566,853 A * 10/1996 Schenker et al. ..... 220/581

(Continued)

FOREIGN PATENT DOCUMENTS

| | | | |
|---|---|---|---|
| DE | 19914241 | A1 | 10/2000 |
| EP | 1457758 | A1 | 9/2004 |
| WO | WO 02/36525 | A2 | 5/2002 |
| WO | WO2004/003457 | A1 | 1/2004 |

OTHER PUBLICATIONS

International Search report and Written Opinion of the ISA for PCT/EP2011/058798, ISA/EP, Rijswijk, NL, mailed Jul. 1, 2011.

*Primary Examiner* — Toan To
(74) *Attorney, Agent, or Firm* — Harness, Dickey & Pierce, P.L.C.

(57) ABSTRACT

A gas generator includes an initiator having a case, two electrodes and a cap having a wall delimiting an aperture for insertion of the case, a part delimiting an aperture for access to the electrodes and a retaining part made of plastic material overmolded into the aperture between the initiator, the cap and the part. The wall includes, near the aperture and the protrusion retaining the cap, a second protrusion for supporting the mold in a support direction having a component extending from the bottom toward the aperture, the second protrusion having an outer edge at least partially not covered by the part for use as a support surface in said support direction for a mold to be used for overmolding.

12 Claims, 1 Drawing Sheet

(56) References Cited

U.S. PATENT DOCUMENTS

| | | | | |
|---|---|---|---|---|
| 6,644,206 | B2 * | 11/2003 | Fogle, Jr. | 102/530 |
| 6,763,764 | B2 | 7/2004 | Avetisian et al. | |
| 6,848,713 | B2 * | 2/2005 | Nakashima et al. | 280/741 |
| 6,908,104 | B2 * | 6/2005 | Canterberry et al. | 280/736 |
| 7,370,885 | B2 * | 5/2008 | Stevens | 280/741 |
| 2003/0184068 | A1 * | 10/2003 | Nakashima et al. | 280/741 |
| 2004/0123765 | A1 | 7/2004 | Furusawa et al. | |
| 2004/0212184 | A1 * | 10/2004 | Canterberry et al. | 280/741 |
| 2004/0232679 | A1 | 11/2004 | Kubo et al. | |
| 2004/0251667 | A1 | 12/2004 | Harada et al. | |

* cited by examiner

GAS GENERATOR AND MANUFACTURING PROCESS THEREOF

CROSS-REFERENCE TO RELATED APPLICATIONS

This application is a 371 U.S. National Stage of International Application No. PCT/EP2011/058798, filed May 30, 2011 and published in English as WO 2011/151276 A1 on Dec. 8, 2011. This application claims priority to French Patent Application No. 10 54302, filed Jun. 2, 2010. The disclosures of the above applications are incorporated herein by reference.

FIELD

The invention relates to a gas generator, as well as to a manufacturing process for same.

BACKGROUND

Gas generators are used in particular for inflating an inflatable safety cushion (airbag) or for triggering a seat belt pretensioner in an automobile vehicle.

Such a gas generator customarily includes a hollow body containing gas generation means, such as for example a pyrotechnic charge, as well as an electropyrotechnic initiator for triggering the generation of the gas and its escape through the apertures of a diffuser.

The initiator is electrically controlled by two electrodes, the generator including a case delimiting an aperture giving access from the outside to the electrodes of the initiator.

A retaining part is provided in the aperture between the initiator and the housing to hold them in their relative position, the electrodes crossing outward through the aperture as well as the retaining part.

Said retaining part is customarily made of overmoulded plastic.

One of the problems presented by the overmoulded part is the seal between the overmoulded part and the initiator.

Indeed, moisture must not be allowed to pass from the outside to the inner chamber of the gas generator containing the gas generation means. In particular, said moisture must not be allowed to pass along the two electrodes that are accessible from the outside and along the rest of the initiator.

Document US-A-2004/0232679 describes a gas generator, including an electropyrotechnic initiator, an assembly housing gas generator means arranged to release at least one gas following ignition of the electropyrotechnic initiator, the initiator including a case containing the pyrotechnic charge of the initiator and two electrodes jutting outside the case for electrically controlling the ignition of the pyrotechnic charge of the initiator, the initiator additionally including a cap, which caps the case on the gas generation means side, the gas generator also including a determined part delimiting a first access aperture from the outside to the electrodes of the initiator and a retaining part obtained by overmoulding plastic in the first opening between the initiator, the cap and the determined part, for retaining the initiator and maintaining the initiator in position with respect to the determined part, the electrodes crossing outward through the first aperture and the retaining part, the cap including a bottom integral with a side wall delimiting a second aperture in which the case is inserted, the wall having an outer protrusion for retaining the cap in a corresponding recess in the retaining part.

Thus, document US-A-2004/0232679 provides, for protection against moisture from the outside, for sealing the inside of the hollow body containing the gas generating material with an initiator retaining part, which is an integral part of a member welded to the hollow body. The document indicates that a seal is thus obtained between the retaining part and the hollow body. However, the document does not provide any means for preventing moisture from crossing along the electrodes and along the initiator toward the inside of the hollow body.

Initiators, the cap whereof is surrounded by a part made of plastic, are also known from documents DE-A-19914241, WO 2004/003457 and US-A-2004/0123765. These initiators require an additional separate retaining part gripping the plastic part to hold the initiator within a gas generator.

Document WO 02/36525 describes a system that allows several initiators to be held relative to a metal base by means of a metal part and of an overmoulded nylon body completely surrounding the initiator.

SUMMARY

The invention aims to improve the generator's watertightness between the outside and the inside of the generator by improving the seal between the cap and the overmoulded retaining part in order to prevent outside moisture from crossing along the electrodes and the initiator into the inside of the generator.

To this end, a first object of the invention is a gas generator, including an electropyrotechnic initiator, an assembly containing gas generating means laid out so as to release at least one gas following ignition of the electropyrotechnic initiator, the initiator including a case containing the pyrotechnic charge of the initiator and two electrodes, jutting out outwards from the case for electrically controlling the ignition of the pyrotechnic charge of the initiator, the initiator further including a cap, which caps the case on the gas generating means side, the gas generator further including a determined portion delimiting a first aperture for accessing the electrodes of the initiator from the outside and a retaining part obtained by overmoulding plastic material in the first aperture between the initiator, the cap and the determined portion, for retaining the initiator and holding the initiator in position relatively to the determined portion, the electrodes crossing outwards the first aperture and the retaining part, the cap including a bottom integral with a side wall delimiting a second aperture into which the case is inserted, the wall having a outer protrusion used for retaining the cap in a corresponding recess of the retaining part, characterized in that the side wall of the cap includes, in proximity to the second aperture and to said first protrusion used for retaining the cap, at least one other second mould-supporting protrusion in a supporting direction having a component from the bottom towards the second aperture, said other second mould-supporting protrusion being distinct from said first protrusion and having an outer edge at least partly not covered by the retaining part so as to be used as a supporting surface along said direction supporting a mould which is to be used for overmoulding.

Thus, during overmoulding of the retaining part, the mould presses on the sloping edge of the second protrusion.

The second protrusion allows the mould to push in the direction of tightening the cap toward the initiator case during overmoulding, while the pressure of the plastic material injected during said overmoulding will tend to push the case to the bottom of the cap in the insertion direction, but also to push the cap into the mould in the same direction as said insertion direction.

During overmoulding, the pressure of the injected plastic material on the initiator will tend to push the case into the bottom of the cap in the direction of insertion. Due to the clearance between the bottom of the cap and the bottom of the mould, the cap will be pushed into the bottom of the mould. The sloping outer edge of the second protrusion of the cap already resting on the mold will change the force on the cap which is in the direction of insertion to a transverse force that will deform the protruding area of the cap by closing it toward the case of the initiator.

The thermal shrinkage of the plastic material of the retaining part during its hardening, and after said overmolding in the mold the relaxation of the protruding part of the cap toward its initial shape will increase the contact pressures between the protruding part of the cap and the retaining part.

The tightening effect caused by the mould pressing on the second protrusion, coupled with the constricting effect of the retaining part around the cap, increase the watertightness between the cap and the retaining part.

According to one embodiment, the edge of the second mould-supporting protrusion is sloping with respect to the rest of the outside surface of the second wall of the cap.

According to one embodiment, the case is inserted into the second aperture along an insertion direction toward the bottom, the side wall of the cap surrounding the case transversely to the insertion direction, the outer edge of the second protrusion being sloping with respect to the insertion direction.

According to one embodiment, the second mould-supporting protrusion is peripheral on the second wall of the cap and is entirely not covered by the plastic material of the retaining part.

According to one embodiment, the sloping edge of the second mould-supporting protrusion is trunconical.

According to one embodiment, the sloping edge of the second mould-supporting protrusion has concave curvature.

According to one embodiment, the sloping edge of the second mould-supporting protrusion has convex curvature.

According to one embodiment, the sloping edge of the second mould-supporting protrusion is flat.

According to one embodiment, the retaining part is overmoulded in a part forming a recess located on the outside surface of the cap between the first protrusion and the second protrusion for sealing the retaining part within the cap.

According to one embodiment, the second protrusion is adjacent to a rim covered by the plastic material of the retaining part, the part forming a recess being delimited by the rim and the first protrusion, the retaining part includes parts with shapes complementary to the first protrusion, to the part forming a recess and to the rim, one inward protruding part whereof located in said part forming the recess located on the outside surface of the cap.

According to one embodiment, the retaining part includes a part having an edge aligned with and extending the sloping edge.

A second object of the invention is a manufacturing process for a gas generator as described above, wherein during an overmoulding step the determined part of the generator, the initiator and the cap capping the initiator are placed in a mould and plastic material is injected into the mould and into the first aperture between the initiator, the cap and the determined part, to form the retaining part, the electrodes crossing the first aperture and the retaining part in the outward direction, the plastic material surrounding the first protrusion, characterized in that during the overmoulding step at least one part of the mould is put in contact with the outer sloping edge of the second protrusion to support said mould part in the support direction having a component extending from the bottom toward the second aperture.

BRIEF DESCRIPTION OF THE DRAWINGS

The invention will be better understood upon reading the description that will follow, given only as a non-limiting example with reference to the appended drawings, in which.

DETAILED DESCRIPTION

Figure 1:
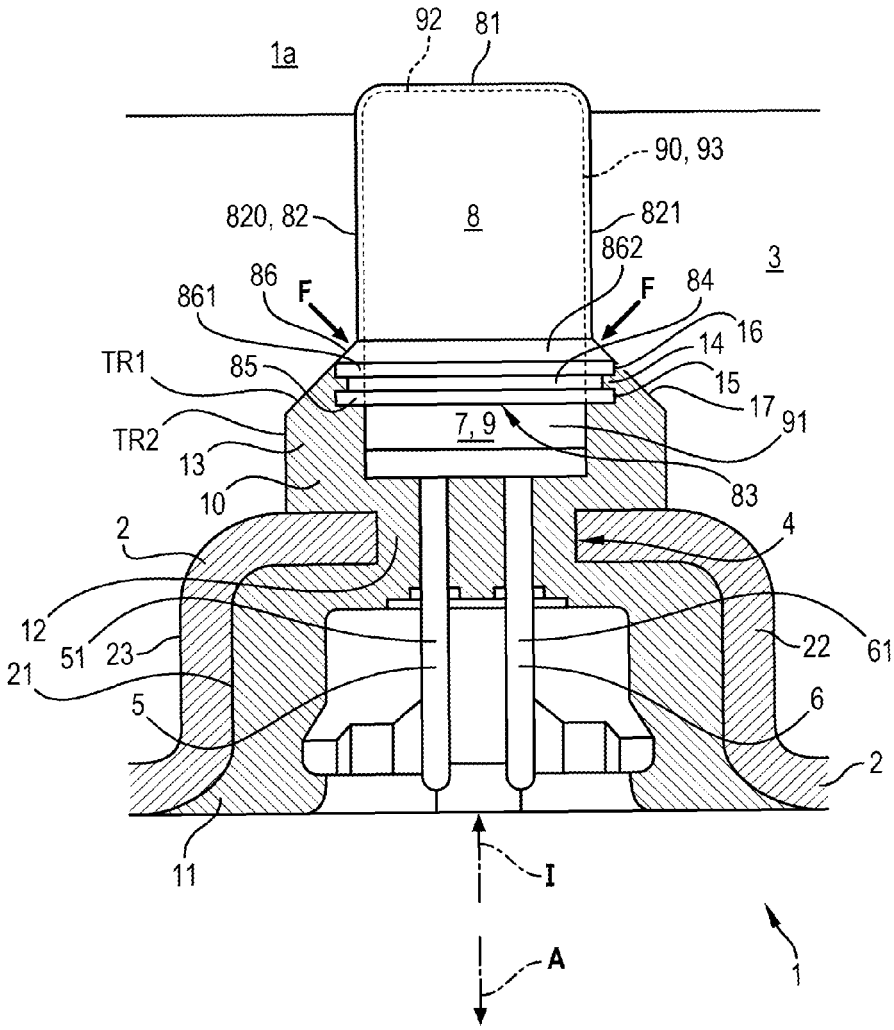
FIG. 1 schematically shows an embodiment of the generator according to the invention.

In FIG. 1, the gas generator 1 includes an assembly of parts 1*a* enclosing, within an inner chamber 3, gas generator means (not shown) which, when they are triggered by an electropyrotechnic initiator 7 produce a gas which is released outward from the assembly 1*a* through an outlet (not shown). The gas generator means include for example a pyrotechnic charge, combustion whereof is brought about by the ignition of the electropyrotechnic initiator 7 and which generates gas, one or more reservoirs of gas under high pressure, the opening whereof is caused by the ignition of the electropyrotechnic initiator 7 and releases gas.

These reservoirs may separately contain reactive gases which, when the reservoirs are opened by the ignition of the electropyrotechnic initiator 7, are mixed and are brought into combustion to generate gas which escapes from the generator outlet. The assembly 1*a* is attached to a determined support part 2 of the electropyrotechnic initiator 7, this determined part 2 consisting for example of a housing 2 in the embodiments shown in the figures. It is self-evident in what follows that the term "housing 2" can be replaced by "determined part of the generator." The ignition of the electropyrotechnic initiator 7 is triggered by sending a prescribed control signal to control electrodes 5, 6 thereof, distinct on from the other.

The case 2 or the determined part 2 includes an aperture 4 allowing passage of the two electrodes 5, 6 of the electropyrotechnic initiator 7 serving to ignite the gas generating means. The aperture 4 is formed for example in an internal recess 22 of case 2.

The electropyrotechnic initiator 7 includes a case 9 enclosing, in another, second inner compartment delimited by a first wall 90, another second pyrotechnic charge of the initiator. The wall 90 is for example metallic. The two electrodes 5 and 6 are made of an electrically conductive material, metallic for example, and are used, as known to the person skilled in the art, to ignite the second pyrotechnic charge contained in the case 9 in response to the fact that an electrical control signal is sent to the electrodes 5 and 6. The electrodes 5 and 6 jut from a first side of the case 9 facing the aperture 4. The wall 90 of the case 9 is electrically insulated from at least one of the two electrodes 5 and 6, for example by an insulating feedthrough, made of glass for example (not shown) provided between said wall 90 and said electrode(s).

The wall 90 of the case 9 is capped by a cap on the gas generator means side. The cap 8 is for example made of an electrically insulating material, for example plastic. In the initiator 7, an ignition element, not shown, electrically connected to the electrodes 5 and 6, is in physical contact with the second internal pyrotechnic charge of the case 9 to ignite, by the Joule effect for example, said second pyrotechnic charge in response to the control signal of the electrodes 5, 6. The cap 8 is positioned in electrically insulating fashion around the case 9, leaving for example a part 91 of the case 9 uncovered on the first side of the electrodes 5 and 6. The cap 8 has a bottom 81 integral with a second side wall 82 delimiting a second aperture 83 distant from the bottom 81. The case 9 is inserted into the aperture 83 along the first insertion direction I toward the bottom 81. When the initiator 7 is inserted into the cap 8, the bottom 92 of the wall 90, which is the part of it that is distant from the part 91, is in contact with the bottom 81, and the lateral part 93 of the wall 90 is, assembly clearance permitting, against the side wall 82 of the cap 8. The wall 82 and the side wall 93 of the wall 90 are cylindrical for example, and can be circular. The second wall 82 surrounds the first wall 90 transversely to the insertion direction I, i.e. in the shown embodiment, the side wall 82 surrounds the lateral part 93 of the wall 90 transversally to the insertion direction I. The lateral part 93 of the wall 90 and the side wall 82 are for example parallel to the insertion direction I. The bottom 81 opens upon ignition of the initiator. Of course, the case 9 and the cap 8 could also open radially through the side wall 82.

A retaining and securing part 10 of the initiator 7 is moulded and secured in the aperture 4 to allow the electrodes 5 and 6 to jut to the outside. The retaining part 10 is therefore an overmoulding 10. The retaining part 10 includes an outside part 11 coming against the outside surface 21 of the housing 2 delimiting the aperture 4, a second intermediate part 12 located in the aperture 4 and a third inner part 13 in contact with the case 9 and the cap 8. On the other side of the outer surface 21, the housing 2 includes an inner surface 23 facing the inner chamber 3 of the gas generator 1. The first part 11, the second part 12 and the third part 13 are interconnected and consist for example of a single part. The retaining part 10 is made by overmoulding on the housing 2, the cap 8 and the initiator 7.

The first and second electrodes 5, 6 include respectively the first and second parts 51, 61 outside of the chamber 3 and not covered by the retaining part 11. The electrodes 5, 6 can thus be connected by their outside parts 51, 61 to an electrical control circuit outside of the generator 1.

On the side of the aperture 83, the wall 82 includes a first protrusion 85 serving to retain the cap 8 in the overmoulded retaining part 10. The first protrusion 85 is retained in a corresponding recess 15 of the part 10.

The second wall 82 includes near the second aperture 83 and the first protrusion 84, at least one other second mould-supporting protrusion 86. The second protrusion 86 is distinct from the first protrusion 85. The second protrusion 86 is used to support a mould to be used for overmoulding in a support direction F having a component A extending from the bottom 81 of the cap 8 toward the second aperture 83. The second protrusion 86 has an outer edge 862 at least partially not covered by the retaining part 10 to serve as a support surface in said support direction F for the mould to be used for overmoulding. The component A consists for example of the geometrical axis of revolution of the cap 8, around which the wall 82 is located. The component A is for example congruent with the insertion direction I, being the reverse of said insertion direction I. The outer edge 862 of the second protrusion 86 is sloped with respect to the component A surrounded by the wall 82. The component A is called the longitudinal axis A of the initiator 7, being directed from the bottom 81 toward the pins 5 and 6.

The outer edge 862 of the second protrusion 86 is sloped with respect to the insertion direction I. The edge 862 is sloped with respect to the main surface 820 of the wall 82 surrounding the case 9 starting at the bottom 81. The outer surface 820 of the wall 82 being for example parallel to the insertion direction I, the edge 862 is sloped with respect to the rest of the wall 82 and at this surface 820. For example, the sloping support edge 62 is totally not covered by the retaining part 10. For example, the second mould support protrusion 86 is peripheral on the second wall 82 of the cap 8 around the insertion direction I and is entirely not covered by the plastic material of the retaining part 10.

A part 84 forming a recess is provided in the outer surface of the cap 8, to wit on the outer surface 820 of the side wall 82. The retaining part 10 is overmoulded on the recessed part 84 to ensure a hermetic moisture seal between the chamber 3 and the retaining part 10 and to prevent any axial movement of the cap 8. The recessed part 84 of the cap is provided between the first protrusion 85 and the second protrusion 86.

In the direction of the aperture 83, the second protrusion 86 is adjacent to a rim 861 covered by the retaining part 10. The rim 861 extends the sloping edge 862 in the direction of the aperture 83. The recessed part 84 is for example delimited by the rim 861 and the first protrusion 85, with for example the recessed part 84 wider transversely to the I direction than the surface 820 and less wide than the rim 861 of the first protrusion 85.

The retaining part 10 is overmoulded not only on the first protrusion 85, which is the lower one farthest from the bottom 81 and closest to the aperture 83, but is also overmoulded in the recess of part 84 and on the rim 861. The protrusion 85, the recessed part 84 and the rim 861 are for example straight and cylindrical, for example parallel to the I direction. The sloping edge 862 of the second protrusion 86 is located on the side of the bottom 81 and is farther from the aperture 83 than the rim 861, the recessed part 84 and the protrusion 85 in the I direction. The sloping edge 862 of the second protrusion 86 joins the rest of the surface 820 of the second wall 82 of the cap 8 on the side situated toward the bottom 81.

Thus, the retaining part 10 includes, in addition to the first inner recessed part 15 receiving by complementary shape matching the first protruding part 85, a second inward protruding part 14 receiving by complementary shape matching the recessed part 84 of the cap and a third part 16 applied against the rim 861. Consequently, in the retaining part 10, the second inward protruding part 14 is adjacent on one side to the first recessed part 15 and is adjacent on the other side to the third part 16.

The sloping edge 862 of the second protrusion 86 is for example trunconical with respect to the surface 820 of the second wall 82, as shown in FIG. 1.

Figure 2:
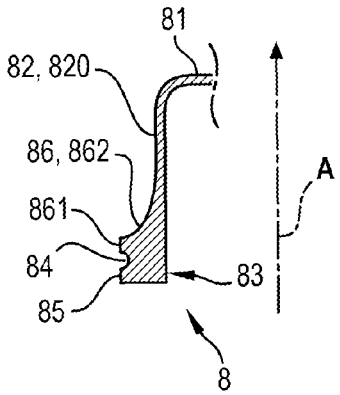
FIGS. 2, 3 and 4 schematically show in section some variations in embodiment of the cap that can be used in the generator of FIG. 1.
Figure 3:
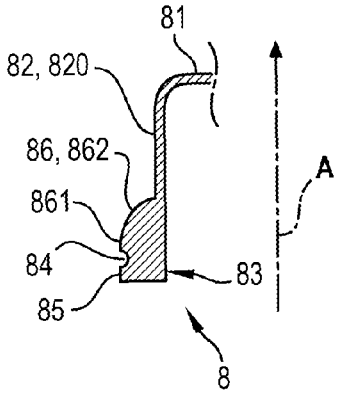
Figure 4:
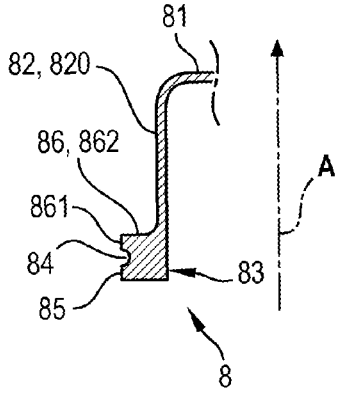

The rim 862 of the second protrusion 86 can also have shapes other than the straight shape of FIG. 1 showing the cap in profile in a plane containing the axis A. FIGS. 2, 3 and 4 are sectional views of variations of the cap 8 in a section plane containing the axis A. For example, the edge 862 of the second protrusion 86 can have a concave curved profile as in FIG. 2 or a convex one as in FIG. 3. As in FIG. 3, the rim 861 can be formed by the lower end of a curved profile containing the edge 862 and the protrusion 86 above it. As in FIG. 4, the edge 862 of the second protrusion 86 can have a plane profile, possibly being perpendicular for example to the axis A and/or to the surface 820 of the wall 82.

Consequently, the edge 862 widens from inside to outside when moving in the direction extending from the bottom 81 to the aperture 83 and the electrodes 5, 6, that is to say in the top to bottom direction in FIG. 1 along the axis A. The part forming a recess 84 and/or the protrusion 85 and/or the protrusion 86 (sloping edge 862) and/or the outer surface 820 of the cap is/are for example a figure/figures of revolution around the axis A.

In the embodiment shown, the overmoulded part 10 covers the first protrusion 85, the second recessed part 84 and the outer rim 861 of the cap 8, ending at said rim 861, without covering the second protrusion 86 and without covering the outer surface 820 of the cap which is located between the first protrusion 86 and the bottom 81, that is without covering the sloping edge 862 and the part 821 of the cap located above it.

The support part 10 includes a part 17 having an edge aligned with and extending the sloping edge 862. The parts 14, 15, 16 are located within this part of the retaining part 10. Of course, in other embodiments not shown, the overmoulded part 10 may only partially cover the sloping edge 862 of the second protrusion 86. For example, the part 17 of the part 10 extends the trunconical sloping edge 862 without a break in the slope, which makes it possible to use a mould with a cavity TR1 free of edges protruding toward the sloping edge 862 and the part 17. Of course, overmouldings 10 having parts 17 with shapes differing from that shown, that is not having an extension of the sloping edge 862, can be provided, for example an overmoulding 10 having a flat horizontal (that is transverse to axis A) surface 17 or having a break in the slope with respect to the sloping edge 862.

In the embodiment of FIG. 1, the part 17 of the part 10 is trunconical and is an extension of the sloping trunconical edge 862 having the same slope, which makes it possible to use a mould having a trunconical cavity TR1 in contact with the sloping rim 862 and the part 17. Of course, the part 17 could be trunconical having a break in the slope with respect to the trunconical sloping edge 862.

A seal is thus formed which increases the water tightness between the cap 8, the initiator 7 and the retaining part 10.

Indeed, moisture which would rise along the electrodes 5, 6 along the case 9 in the retaining part 10 would be trapped in the recessed part 84.

In the embodiment shown in the figures, the parts 14, 15, 16, 84, 85, 86, 861, 862 completely encircle the cap 8 around the insertion direction I, being for instance figures of revolution around said geometric axis A passing through the aperture 4 or the revolution geometric axis A of the initiator 7. Thus the recessed part 84 is formed for example by a groove in the cap 8, delimited on the one hand by the protruding part 85 formed by a rim or shoulder and by the protrusion 86. Consequently, the indicated parts completely encircling the cap 8 are called peripheral, the parts 14, 15, 16, 84, 85, 86, 861, 862 being continuous. Of course, similar shapes that are not figures of revolution can be contemplated for parts 14, 15, 16, 84, 85, 86, 861, 862.

In the embodiment shown in the drawing, the recessed part 84 is therefore plugged by a seal lip 14 made up of the inward protruding part 14 of the retaining part 10.

To manufacture the gas generator according to the invention, the cap 8 is lowered around the initiator 7 to insert the case 9 into the cap 8 in the insertion direction I. Then the housing 2 and the initiator 7 capped with the cap 8 are positioned in the mould, not shown, with one or more parts TR1 of the mould having complementary sloping surfaces pressing against the sloping edge 862 of the initiator. This or these parts TP1 of the mould extend beyond the sloping edge 862 and the cap in width transverse to the axis A in the descending direction extending from the bottom toward the electrodes 5, 6, the mould having for example parts the surfaces whereof extend along the line TR1 and TR2 of FIG. 1. These parts of the mould therefore clasp the cap 8 and the housing 2 to hold them in position during this moulding step.

Plastic material is then injected into the gap between the housing 2, the initiator 7, the cap 8 and the parts of the mould to form the retaining part 10, the plastic material then filling the recessed part 14 and overlying the protrusion 85 and the rim 861.

Thus the mould parts TR1 press inward in the support direction F on the sloping edge 862 of the cap 8 during moulding.

During injection, the plastic material will press on the case 9 in the insertion direction I, which will press the top 92 of the case 9 onto the bottom 81 of the cap.

Once the initiator 7 is pressed to the bottom of the cap, the pressure of the plastic material will tend to push the cap 8 into the bottom of the mould cavity. As the cap 8 is already pressing on the mould cavity at its sloping edge 862 bearing on the mould part TR1 in the F direction, the pressure of the plastic material and the push of the mould TR1 on the sloping edge 862 will cause the cap 8 to tend to close in upon the case 9 following the force lines F inclined with respect to the I direction and with respect to the surface 820, to fill in the clearance between the wall 82 of the cap 8 and the wall 93 of the case 9.

The deformation of the cap is brought about by the elasticity of the material making up the cap (plastic for example, which can be polyamide, polypropylene or any other injection-mouldable material meeting the loads to which said component is subjected) and/or the customary assembly clearances between the cap 8 and the case 9 and/or the customary assembly clearances between the cap 8 and the bottom of the mould cavity. The overmoulded plastic material making up the retaining part 10 can for example be made of polyamide, polypropylene or any other injection-mouldable material meeting the loads to which this component is subjected.

After injection and after having removed the mould, the plastic material of the support part 10 hardens and undergoes inward, that is toward the initiator 7, thermal shrinkage due to its composition. Conversely, due to the fact that the mould is not pressing anymore on the sloping edge 862 of the cap 8, the sloping edge 862, as well as the protruding rim 861 of which it is an integral part, tend to return outward, that is toward their initial shapes before the moulding of the retaining part 10. There results a reinforced seal in the recessed part 14 by the retaining part 10.

The part 84 forming the recee makes it possible to improve the mechanical connection between the cap 8 and the overmoulding 10 and to improve contact pressures of the overmoulding 10 on the cap 8.

In one embodiment a gas generator (1) is provided, including an electropyrotechnic intiator (7), an assembly enclosing gas generation means designed to release at least one gas following ignition of the electropyrotechnic initiator (7), the initiator (7) including a case (9) having at least a first wall containing the pyrotechnic charge of the initiator and two electrodes (5, 6) jutting toward the outside of the case (9) for electrically controlling the ignition of the pyrotechnic charge of the initiator, the generator additionally including a cap (8) made of an electrically insulating material, which caps the case (9) on the gas generation means side, the gas generator (1) also including a housing (2) delimiting a first aperture (4) for outside access to the electrodes (5,6) of the initiator and a retaining part (10) obtained by overmoulding of plastic material in the first aperture (4) between the initiator (7), the cap (8) and the housing (2), to retain the initiator (7) and hold the initiator (7) in position with respect to the housing (2), the electrodes (5,6) crossing the first aperture (4) and the retaining part (10) outward, the cap (8) including a bottom (81) integral with a second side wall (82) delimiting a second aperture (83) into which the case (9) is inserted along a direction (A) of insertion toward the bottom (81), the second wall (82) surrounding the first wall of the case (9) transversely to the direction (A) of insertion and having an outside transverse protrusion (84) used to retain the cap (8) in a corresponding recess (15) of the retaining part (10), characterized in that the second wall (82) of the cap (8) includes, near the second aperture (83) and said first protrusion (84) used for retaining the cap (8) at least one other second mould-supporting protrusion (862), distinct from said first protrusion (84), the other second protrusion (862) having an outer edge (862) sloping with respect to the insertion direction (A) and at least partially not covered by the retaining part (10) to serve as a support surface for a mould to be used for the overmoulding.

The invention claimed is:

1. A gas generator comprising:

an electropyrotechnic initiator; and an assembly containing a gas generator for releasing at least one gas following ignition of the electropyrotechnic initiator;

the initiator includes a case containing a pyrotechnic charge of the initiator and two electrodes jutting out outwards from the case for electrically controlling the ignition of the pyrotechnic charge of the initiator, the initiator further including a cap which caps the case on a gas generating side, the gas generator further includes a determined portion delimiting a first aperture for accessing the electrodes of the initiator from the outside and a retaining part obtained by overmoulding plastic material in the first aperture between the initiator, the cap and the determined portion, the retaining part for retaining the initiator and holding the initiator in position relatively to the determined portion, the electrodes crossing outwards the first aperture and the retaining part, the cap including a bottom integral with a side wall delimiting a second aperture into which the case is inserted, the wall having a first protrusion used for retaining the cap in a corresponding recess of the retaining part, wherein a side wall of the cap includes, in proximity to the second aperture and to the first protrusion used for retaining the cap, at least one other second mould-supporting protrusion in a supporting direction having a component from the bottom towards the second aperture, the other second mould-supporting protrusion being distinct from the first protrusion and having an outer edge at least partly not covered by the retaining part so as to be used as a supporting surface along the direction supporting a mould which is to be used for overmoulding.

2. The gas generator according to claim 1, wherein the edge of the second mould-supporting protrusion is a sloping edge sloping with respect to a remainder of the outside surface of the second wall of the cap.

3. The gas generator according to claim 1, wherein the case is inserted into the second aperture along an insertion direction toward the bottom, the side wall of the cap surrounding the case transversely to the insertion direction, the outer edge of the second protrusion being sloping with respect to the insertion direction.

4. The gas generator according to claim 1, wherein the second mould-supporting protrusion is peripheral on the second wall of the cap and is entirely not covered by the plastic material of the retaining part.

5. The gas generator according to claim 2, wherein the sloping edge of the second mould-supporting protrusion is trunconical.

6. The gas generator according to claim 2, wherein the sloping edge of the second mould-supporting protrusion has concave curvature.

7. The gas generator according to claim 2, wherein the sloping edge of the second mould-supporting protrusion has convex curvature.

8. The gas generator according to claim 2, wherein the sloping edge of the second mould-supporting protrusion is flat.

9. The gas generator according to claim 1, wherein the retaining part is overmoulded in a part forming a recess located on the outside surface of the cap between the first protrusion and the second protrusion for sealing the retaining part within the cap.

10. The gas generator according to claim 9, wherein the second protrusion is adjacent to a rim covered by the plastic material of the retaining part, the part forming a recess being delimited by the rim and the first protrusion, the retaining part includes parts with shapes complementary to the first protrusion, to the part forming a recess and to the rim, one inward protruding part whereof located in said part forming the recess located on the outside surface of the cap.

11. The gas generator according to claim 2, wherein the retaining part includes a part having an edge aligned with and extending the sloping edge.

12. A manufacturing process for a gas generator according to claim 1, wherein during an overmoulding step the determined part of the generator, the initiator and the cap capping the initiator are placed in a mould and plastic material is injected into the mould and into the first aperture between the initiator, the cap and the determined portion, to form the retaining part, the electrodes crossing the first aperture and the retaining part in an outward direction, the plastic material surrounding the first protrusion, wherein during the overmoulding step at least one part of the mould is put in contact with the outer sloping edge of the second protrusion to support a mould part in the support direction having a component extending from the bottom toward the second aperture.

* * * * *